US006519989B1

(12) United States Patent
Hirvi

(10) Patent No.: US 6,519,989 B1
(45) Date of Patent: Feb. 18, 2003

(54) LEVER LOCK UNIT

(75) Inventor: Jorma Hirvi, Ärla (SE)

(73) Assignee: AB FAS Lasfabrik (SE)

( * ) Notice: Subject to any disclaimer, the term of this patent is extended or adjusted under 35 U.S.C. 154(b) by 0 days.

(21) Appl. No.: 09/254,792

(22) PCT Filed: Sep. 12, 1997

(86) PCT No.: PCT/SE97/01542

§ 371 (c)(1),
(2), (4) Date: Mar. 12, 1999

(87) PCT Pub. No.: WO98/11315

PCT Pub. Date: Mar. 19, 1998

(30) Foreign Application Priority Data

Sep. 15, 1996 (SE) ..... 9603341

(51) Int. Cl.[7] ..... E05B 29/04

(52) U.S. Cl. ..... 70/492; 70/495; 70/409; 70/419

(58) Field of Search ..... 70/377, 409, 419, 70/492, 495, 496

(56) References Cited

U.S. PATENT DOCUMENTS

| | | | | | |
|---|---|---|---|---|---|
| 828,961 | A | * | 8/1906 | Owens | 70/419 |
| 1,594,450 | A | | 8/1926 | Calabrese | |
| 1,823,411 | A | * | 9/1931 | Schori | 70/492 |
| 3,505,841 | A | | 4/1970 | Sinclair | |
| 3,537,284 | A | * | 11/1970 | Taylor | 70/409 |
| 4,030,325 | A | | 6/1977 | Ehrat | 70/383 |
| 4,109,495 | A | * | 8/1978 | Roberts | 70/377 X |
| 4,598,563 | A | * | 7/1986 | Berkowitz | 70/492 |

FOREIGN PATENT DOCUMENTS

| | | | | |
|---|---|---|---|---|
| DE | 84696 | | 5/1895 | |
| DE | 95876 | | 5/1896 | |
| DE | 134217 | * | 9/1902 | 70/495 |
| DE | 595834 | * | 4/1934 | 70/409 |

* cited by examiner

*Primary Examiner*—Lloyd A. Gall
(74) *Attorney, Agent, or Firm*—D. Peter Hochberg; Katherine R. Vieyra; Sean Mellino

(57) ABSTRACT

A lever lock unit includes a housing, a dogging element adapted to actuate a lock bolt, a plurality of lever tumblers that are actuable via the dogging element and movable relative thereto, and a blocking element for blocking movement of the dogging element in the absence of a key or when the wrong key is inserted in the unit. The unit is characterized by a cradle accommodated in the dogging element and adapted to receive the lever tumblers. The dogging element is rotatable and is adapted so that when rotated, the cradle accommodated in the dogging element, and there with also the lever tumblers accomodated in the cradle, will be caused to move linearly in relation to the dogging element and in relation to a key inserted into the unit, for movement of the lever tumblers to a blocking element release position when the correct key is inserted.

12 Claims, 4 Drawing Sheets

LEVER LOCK UNIT

FIELD OF INVENTION

The present invention relates to a lever lock unit, and more particularly to a lever lock unit in which movement of the lever tumblers is such as to make forcing and manipulation: of the lock difficult to achieve.

The invention also relates to a key for use with such a lock.

BACKGROUND ART

Known lever locks are constructed so that when turning the lock key, the key seeks for the lever tumblers in order to move the levers to a lock-release position in accordance with a code on the key. This general principle, whereby the key seeks and actuates the lever tumblers as the key is turned is beset with many draw-backs.

One of these drawbacks is that turning of the key results in wear between key and lever tumblers, which results in wear marks on both key and lever tumblers in the passage of time. These marks can facilitate manipulation and forcing of the lock.

Another drawback is that a multi-key/tumbler system cannot be readily implemented in some lock units of this kind, due to the particular design of the lever tumblers.

German Patent Specification 394 690 (Deutsche T ürschlieβ-er-Industrie Wilhelm Müller) teaches a lever lock that includes a plate which, when moved, dogs a number of lever tumblers into a lock release position when the correct key is inserted. This relative movement between plate and lever tumblers, and also between plate and key, is a combination of linear movement and rotary movement. This does not avoid the drawback whereby wear marks are formed on the key and lever tumblers.

OBJECTS OF THE INVENTION

One object of the present invention is to provide a lever lock unit which is more secure than earlier known lock units or assemblies of this kind.

Another object is to provide a lever lock unit with Which a key/lever tumbler system,n can be easily included.

Another object of the invention is to provide a lock unit which can be constructed from a wide choice of materials.

Still another object of the invention is to provide a key that can be used with such a lock unit.

DISCLOSURE OF THE INVENTION

This object is achieved with a lever lock unit that is accommodated in a housing and includes a dogging element adapted to actuate a lock bolt, a plurality of lever tumblers that are actuable via the dogging element and movable relative thereto, and a blocking element for blocking movement of the dogging element when no key is inserted, or when the wrong key is inserted, wherein the lever lock unit is characterized by a cradle carried in the dogging element and adapted to accommodate the lever tumblers, wherein the dogging element is rotatable and so adapted that rotation of the dogging element will cause the cradle accommodated in the dogging element, and therewith the lever tumblers accommodated in the cradle, to move linearly in relation to the dogging element and in relation to a key inserted in the lock, so as to bring the lever tumblers to a blocking element release position when the correct key has been inserted.

The decisive difference between conventional locks in which the key seeks the lever tumblers and lifts the same and the inventive lock construction, is that in the case of the inventive lock construction the lever tumblers, instead, seek the key and stop in the position given by the code.

Another difference is that turning of the key causes the cradle to move linearly through the coaction of means provided thereon with corresponding means in one part or the other part of the fixed housing.

One of the advantages afforded by the invention is that wear between key and lever tumblers is minimized, thereby avoiding the easily read wear marks that a conventional key will leave on a lever tumbler when striking the same. This greatly increases security of the lock against unauthorized manipulation.

Minimization of key wear on the lever tumblers also enables key and tumblers to be made from a wider variety of materials.

The invention also relates to a lock according to claim 11 or claim 12. The key is adapted for use with a lock of the general principle defined in claim 1.

Further preferred embodiments of the invention are set forth in the following dependent claims.

BRIEF DESCRIPTION OF TEE DRAWINGS

The invention will now be described in more detail with reference to an exemplifying embodiment thereof and also with reference to the accompanying drawings, in which FIG. 1 is a perspective view of an inventive lock unit;

FIG. 2 is a perspective exploded view of the lock unit shown in FIG. 1, and also shows a key for use with the lock;

FIGS. 3*a*–3*f* illustrate different stages of a lock locking operation;

DETAILED DESCRIPTION OF PREFERRED EMBODIMENTS

Preferred embodiments of the inventive lever lock unit, or latch unit, will now be described in more detail.

Figure 1:
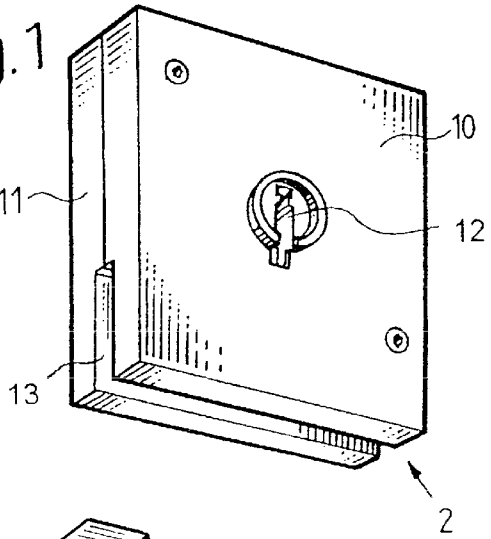

FIG. 1 shows a lock unit comprising a lock chest having an upper part 10 and a lower part 11, said parts being screwed together. Both of the chest halves include a key receiving hole 12. The two chest halves also define an opening 13 through which a lock bolt is able to move.

Figure 2:
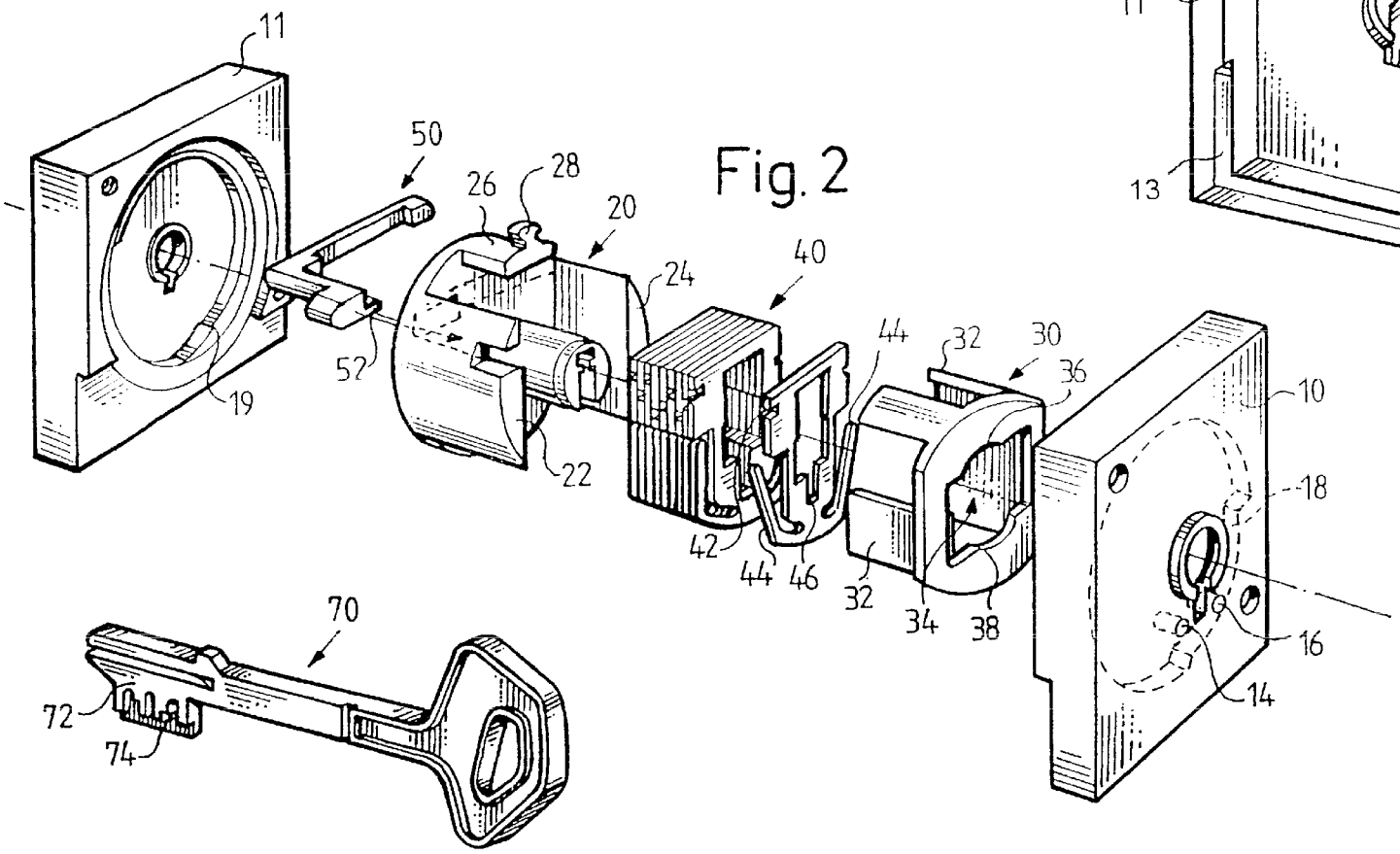

The components of the lock unit 2 are shown in FIG. 2. Rotatably mounted in the lock chest is a dogging element which in the illustrated embodiment has the form of a drum 20 which is intended to accommodate a cradle 30 between drum walls 22, 24 and 26. The drum walls are designed to permit linear relative movement between drum and cradle. As the drum rotates, the cradle 30 is caused to move linearly in relation to the drum by pins 14, 16 that are mounted in the upper chest part 10 and that coact with a curve 36, 38 in the form of a cavity or opening 34 in the cradle.

The cradle accommodates a plurality of lever tumblers 40, for instance nine tumblers. These lever tumblers are mutually identical with the exception of the position of code reading grooves or recesses 42 in the side edges of respective tumblers. These recesses or grooves are positioned at mutually different heights corresponding to the pitch of the key code. The tumblers have a width which allows the tumblers to pass between walls 32 of the cradle 30. Each lever tumbler is provided with two resilient tongues 44, for abutment with the walls 32. This provides frictional resistance against relative movement between cradle and lever tumbler.

Thus, the cradle and lever tumblers rotate as the drum rotates, while the cradle opening, at the same time, moves relative to the pins 14, 16 in the upper chest part. Since the lever tumblers are guided in the cradle in the aforesaid manner, the tumblers will accompany the cradle as it moves until they reach their positions relative to the key, whereupon the resilient tongues 44 hold the tumblers in their adopted positions.

A code slide 50 is mounted in the drum 20 for movement at right angles to movement of the cradle in relation to the drum, and forms a code reading part of the lock. The code slide 50 carries a sensing or detecting projection 52 which functions to detect whether or not the correct key has been used in the following manner. As earlier mentioned, the various lever tumblers 40 are displaced to mutually different extents in relation to the drum, and therewith in relation to the code slide 50, in accordance with the code on the inserted key. When the key code is the correct code, the lever tumblers are moved so that the recesses or grooves 42 in the tumbler side edges form a through-penetrating passageway. The code slide can then be pressed into the passageway formed by said side recesses or grooves 42 by a cam 18 mounted on the upper chest part 10. This cam 18 also blocks rotation when the wrong key is inserted. The code slide thus corresponds to the latch pin of a typical lever lock.

FIG. 2 also shows a key 70 for use with the inventive lock unit. The key includes a key bit 72 which has code surfaces or code grooves 74 cut in one side surface thereof. In the basic embodiment, the other side surface (not shown) of the key lacks code grooves but is machined to a depth that corresponds to the depth of the code grooves.

The key bit has a shape and dimensions that coincide with a key-bit receiving recess 46 in respective lever tumblers 40. The depth of this recess is such as not to impede linear movement of the tumblers in relation to the key as the drum is turned. Instead, this linear movement of the lever tumblers is stopped when the key bit has been inserted into the recess 46 to an extent at which the lever tumblers lie against the code groove 74. Thus, it is the lever tumblers that move towards the key and that are brought to respective positions in accordance with the key on the key bit.

Function

A lock locking operation will now be described with reference to FIGS. 3*a*–3*f*.

Figure 3:
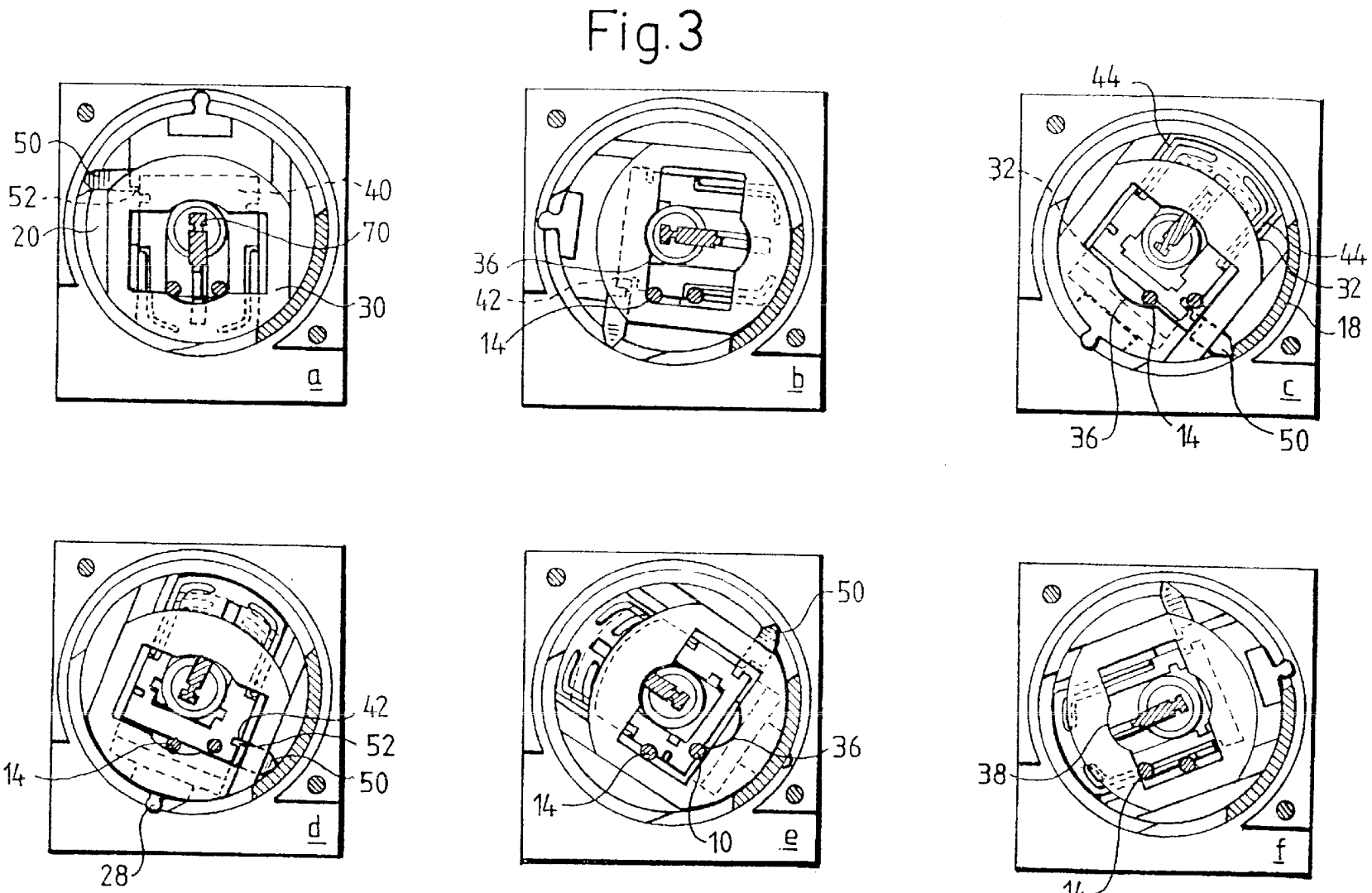

FIG. 3*a* shows a starting position in which all lever tumblers are at mutually the same height. This position allows a key to be inserted into the lock.

FIG. 3*b* shows the position after the drum 20 has been turned anti-clockwise through about 90°. Rotation of the drum is caused by turning the inserted key, which causes the drum to rotate.

Further anti-clockwise rotation causes the cradle, and therewith the lever tumblers, to be moved linearly by the pin 14 in relation to the drum.

FIG. 3*c* shows the state of the lock after anti-clockwise rotation through about 130°. In this state of the lock, the cradle has been moved maximally in relation to the drum, which will be evident by the fact that the pin 14 has reached the rounded part of the curved surface 36. The lever tumblers are in their final positions, or lock release positions, in this stage. The lever tumblers therewith press against the key, when the cradle has moved linearly The lever tumblers are retained in their adopted positions, by the frictional effect of the tongues 44 against the cradle walls 32.

As before mentioned, the code reading recesses form a through-passing passageway for the code slide when the correct key is inserted. The code slide 50 can therewith be pressed-in, i.e. moved in a direction perpendicular to the direction in which the cradle and the lever tumblers have been moved on the other hand, if an incorrect key has been inserted, no through-passing passageway will be formed and the code slide cannot be pressed-in, and rotary movement will be stopped by abutment of the code slide with the cam 18.

FIG. 3*d* shows the code reading projection or talon 52 on the code slide 50 pressed into the passageway formed by the recesses 42. Turning of the key, and therewith the drum, can therefore be continued.

FIG. 3*e* illustrates the lock components when an angle of 130° remains of the anti-clockwise rotary movement. The code slide 50 has been caused to leave the passageway formed by the lever tumblers by a second cam 19 (FIG. 2) on the lower chest part, and the fixed pins 14, 16 in the upper chest half have moved out of engagement with the first curve 36 in the cradle.

FIG. 3*f* shows that continued rotation brings the second curved surface 38 in the cradle opening 34 and the first pin 14 into contact with one another, whereby the cradle and, thereby, the lever tumblers are returned to the starting position shown in FIG. 3*a*.

Figure 4:
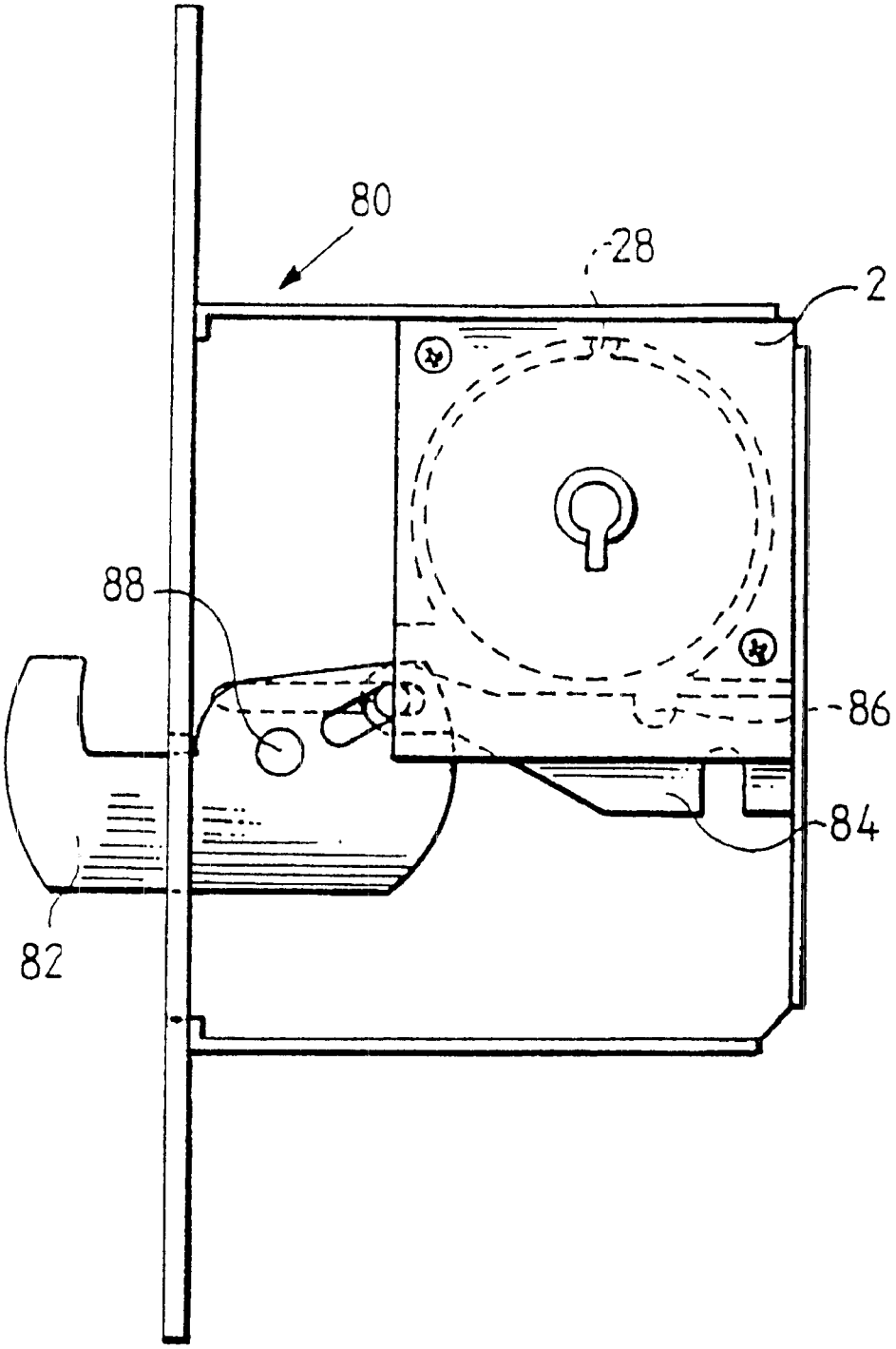
FIG. 4 illustrates coaction of the lock unit with a lock bolt mounted in a lock chest.

In the aforedescribed rotation of the drum, a bolt actuator 28 actuates a lock construction so as to lock the lock, see the following description of FIG. 4.

The aforedescribed sequence of events is reversed when rotating the drum in the opposite direction, i.e. clockwise in FIGS. 3*a*–3*f*. One difference is that the second pin 16 is the first pin to engage the curved surfaces 36, 38 in the cradle opening, and not the first pin 14.

FIG. 4 shows the coaction of a lock unit 2 housed in a lock chest 80 with a locking bolt or latch bolt 82, via a link arm 84. When the drum 20 is caused to rotate clockwise, by turning the key 70 clockwise in the lock, the bolt actuator 28 will engage in a recess 86 on the link arm 84 after the drum has been turned through about 170°. Further clockwise rotation of the key urges the link arm to the left in the Figure, wherewith the bolt 82 mounted on pivot 88 is caused to rotate clockwise into the lock chest, therewith unlocking the door. When locking the door, the movements are the reverse to those described, i.e. the key is turned anti-clockwise and the lock bolt is rotated clockwise out from the lock chest.

Description of an Embodiment that Includes a Latch Pin

The lock of the aforedescribed embodiment has a given level of security, i.e. the code grooves on the key bit determine whether or not the drum can be rotated. With the intention of providing greater security, there is proposed a further preferred embodiment in which the lock unit also includes latch pins that are intended to block movement of the lever tumblers 40 when a wrong key is inserted into the lock.

Figure 5:
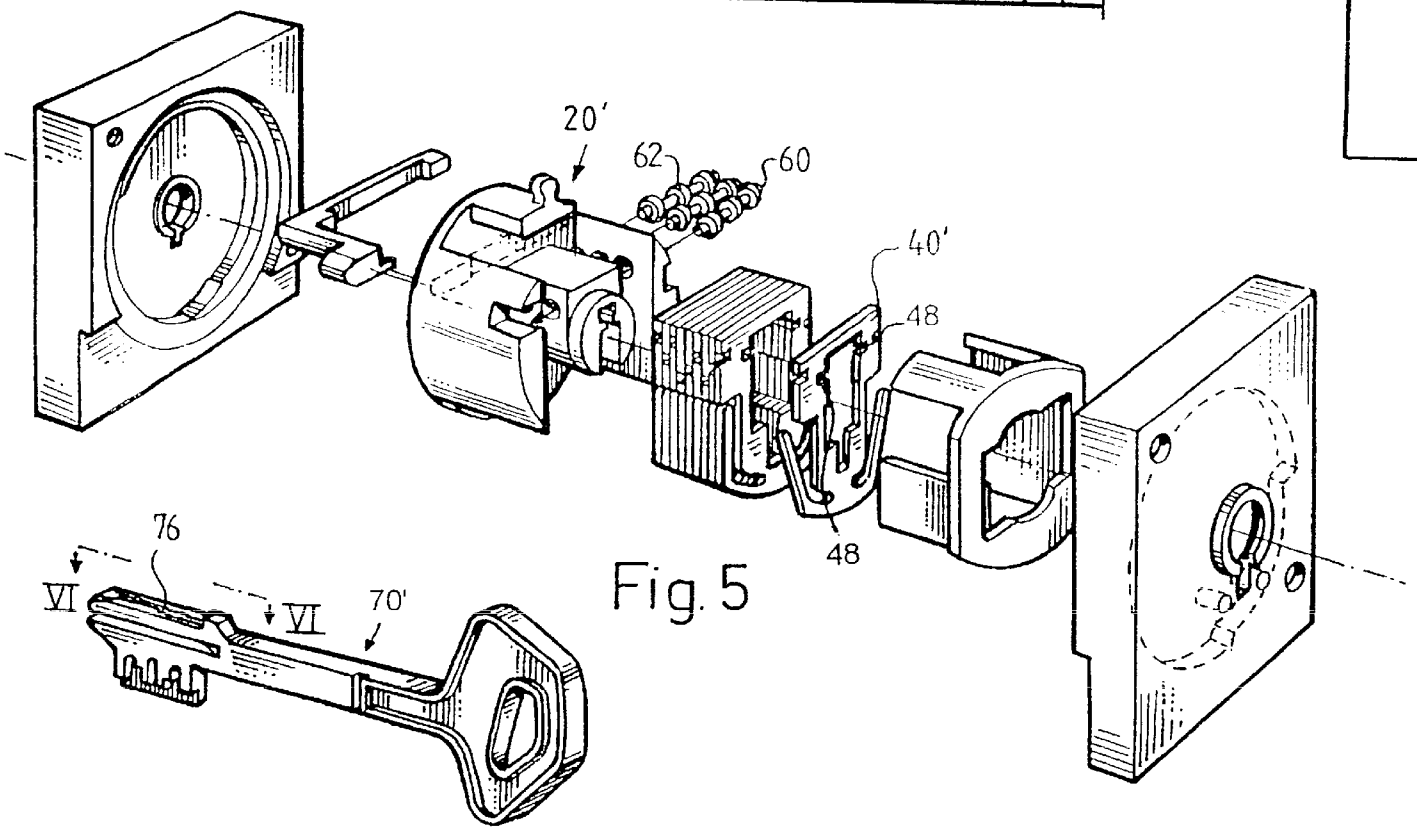
FIG. 5 is a perspective exploded view of an alternative embodiment of the lock unit shown in FIG. 1, and shows a key for use with this alternative unit.

FIG. 5, which corresponds to FIG. 2 illustrating the first embodiment, shows the further embodiment that includes latch pins, wherein those components of the FIG. 2 embodiment that find correspondence in the FIG. 5 embodiment have been identified by the same reference numerals to which a prime has been added.

Figure 7:
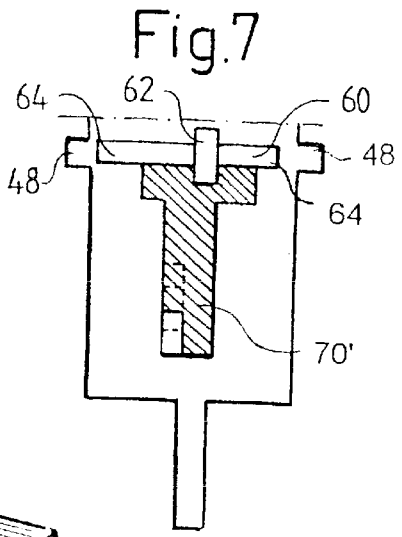
FIG. 7 illustrates coaction of a lever tumbler with a latch pin in the unit shown in FIG. 5.

It will be evident from FIG. 5 that a plurality of latch pins 60 are linearly mounted in the drum 20' for linear movement transversely to the direction of movement of the lever tumblers 40'. The lever tumblers include a recess or notch 48 in the side surfaces of an opening in the lever tumblers, see FIG. 7. These notches 48 are disposed at a height or level which enables a latch pin 60 to engage in a respective notch when the lever tumblers 40' are located in their respective start positions.

Figure 6:
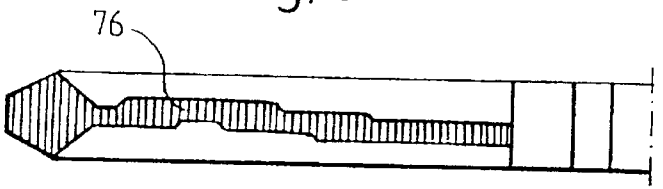
FIG. 6 is a more detailed view of a groove in the spine of the key shown in FIG. 5.

Movement of the latch pins 60 is guided forcibly by a groove 76 provided on the spine of the key 70' and the shape of which will be seen more clearly from FIG. 6. Insertion of the key into the lock unit guides a circumferentially extending flange 62 on the latch pin to a position on a level with the pin concerned, this position being determined by the groove 76 in the key spine. If the key does not have the correct spine code, i.e. the correct groove shape, at least one of the latch pins 60 will be brought to a position in which a latching end 64 of said pin engages a corresponding notch 48 in a lever tumbler 40', thereby blocking linearly movement of the lever tumbler in relation to the drum.

Description of Further Embodiments

As will be evident from the drawings, the general shape of the lever tumblers is generally symmetrical in an axial direction, with the exception of the recess 42. In the preferred embodiment, the recesses 42 are disposed at different heights in both left and right side edges, as evident from FIG. 2. This provides a lever tumbler which can be used for two different coding positions, simply by turning the tumblers about face. This is beneficial, because it reduces the number of different lever tumblers required and therewith the number that must be kept in stock. For instance, four different types of lever tumbler will suffice for seven different coding positions.

Furthermore, several code-slide receiving recesses 42 can be provided on one and the same side surface. Such lever tumblers may be used in locks having mutually different key levels. This enables the provision of lock systems, i.e. a system in which several different key codes fit one and the same lock.

The lever tumblers 40, 40' of the described lock unit are preferably made of brass, although they may alternatively be made of some reinforced plastic material.

The illustrated key 70, 70' has grooves cut in only one side surface of the key bit 72. However, corresponding grooves may also be cut on the other side of the key bit, said codes on respective sides being either symmetrical or asymmetrical. This provides greater security, since more key combinations are therewith made possible.

In all of the illustrated embodiments, the drum, the cradle, and the lever tumblers are rotated by turning a key inserted into the lock. However, other turning means are conceivable. For instance, the drum may be connected to an electric motor or to a handle or knob, such as in the case of a vault or safe, for instance. The key need not therewith be provided with a typical key grip or the like. The key is also subjected to less force, which enables it to be made of a weaker material, such as a plastic material.

It will be understood that the lock unit need not necessarily be placed in a lock chest, as illustrated in the FIG. 4 example. Instead, the lock unit may be mounted on the outside of a door, in which case the unit will have a cylindrical configuration.

What is claimed is:

1. A lever lock unit which is housed in a casing and which includes a dogging element which functions to actuate a lock bolt;

a plurality of lever tumblers that are actuable by the dogging element and movable relative thereto; and a blocking element for blocking movement of the dogging element in the absence of a key or when the incorrect key has been inserted, wherein a cradle which is accommodated in the dogging element and adapted to receive the lever tumblers, wherein the dogging element is rotatable and adapted so that rotation of the dogging element will cause both the cradle accommodated in the dogging element, and the lever tumblers accommodated in the cradle, to move linearly in relation to the dogging element and to a key inserted in the lock unit, for movement of the lever tumblers to a blocking element release position when a correct key is inserted.

2. A unit according to claim 1, wherein the lever tumblers are retained in said release position by frictional forces acting between the lever tumblers and the cradle.

3. A unit according to claim 2, wherein the frictional forces are generated by spring devices formed integral with the lever tumblers.

4. A unit according to claim 1, wherein the cradle and lever tumblers accommodated therein are caused to move linearly by coaction between a first and a second curved surface in the cradle and means in the casing.

5. A unit according to claim 1, wherein the dogging element is caused to rotate by turning a key inserted into the unit.

6. A unit according to claim 1, wherein means are mounted on the dogging element for actuating the lock bolt.

7. A unit according to claim 1, wherein the lever tumblers have side surfaces, and wherein at least one recess is provided in at least one of the side surfaces of the lever tumblers, for receiving a projection on the blocking element.

8. A unit according to claim 1, wherein the lever tumblers have side surfaces, and wherein at least two recesses maybe provided in one of the side surfaces of the lever tumblers, for receiving a code reading projection on the blocking element, whereby the lever tumblers provided with at least two recesses have a number of release positions corresponding to the number of recesses in one of the side surfaces of said lever tumblers.

9. A unit according to claim 1, wherein at least one latch pin is mounted on the dogging element and movable in a plane perpendicular to the movement direction of the lever tumblers and adapted to coact with a groove on an inserted key, and at least one notch is provided on the lever tumblers.

10. A unit according to claim 9, wherein the latch pin has a circumferentially extending flange which coacts with the groove on the inserted key in a manner such that when the wrong key is inserted, one end of the pin will engage said notch, thereby blocking movement of the lever tumbler in relation to the dogging element.

11. A key and a lock unit according to claim 1, comprising a key bit, wherein non-penetrating code surfaces are provided on one side surface of the key bit, for coaction with a plurality of lever tumblers.

12. A key and a lock unit according to claim 9 and including a key bit provided with code surfaces, wherein the spine of the key carries a groove for coaction with a flange on a latch pin in the lock unit.

* * * * *